US011064726B2

(12) United States Patent
Fujisawa et al.

(10) Patent No.: US 11,064,726 B2
(45) **Date of Patent: *Jul. 20, 2021**

(54) EXTRACTION METHOD OF FLAVOR CONSTITUENT AND MANUFACTURING METHOD OF COMPOSITION ELEMENT OF FAVORITE ITEM

(71) Applicant: JAPAN TOBACCO INC., Tokyo (JP)

(72) Inventors: Yoshinori Fujisawa, Tokyo (JP); Takuma Nakano, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 135 days.

This patent is subject to a terminal disclaimer.

(21) Appl. No.: 15/247,208

(22) Filed: Aug. 25, 2016

(65) Prior Publication Data

US 2016/0360780 A1 Dec. 15, 2016

Related U.S. Application Data

(63) Continuation of application No. PCT/JP2015/055208, filed on Feb. 24, 2015.

(30) Foreign Application Priority Data

Feb. 26, 2014 (JP) ..... JP2014-035429

(51) Int. Cl.
*A24B 15/16* (2020.01)
*A24B 15/24* (2006.01)
(Continued)

(52) U.S. Cl.
CPC ..... *A24B 15/24* (2013.01); *A24B 15/167* (2016.11); *A24B 15/243* (2013.01); *A24B 15/287* (2013.01)

(58) Field of Classification Search
None
See application file for complete search history.

(56) References Cited

U.S. PATENT DOCUMENTS 1,538,265 A 5/1925 Arnold
2,565,052 A * 8/1951 Sowa ..... A24B 15/24 131/275
(Continued)

FOREIGN PATENT DOCUMENTS

CN 1050540 A 4/1991
CN 103589514 A 2/2014
(Continued)

OTHER PUBLICATIONS

Database WPI, Week 199211, Thomson Scientific, London, GB; AN 1992-080599, XP002781325 & CN 1 050 540 A (Feng Shixing) Apr. 10, 1991, abstract.
(Continued)

*Primary Examiner* — Phu H Nguyen
(74) *Attorney, Agent, or Firm* — Birch, Stewart, Kolasch & Birch, LLP

(57) ABSTRACT

An extraction method of a flavor constituent comprises: a step A for heating a tobacco raw material which is subjected to an alkali treatment; and a step B for bringing a release component released in the gas phase in the step A into contact with a collection solvent at normal temperature until any time from when a first condition is satisfied to when a second condition is satisfied. The total amount of saccharides contained in the tobacco raw material is 9.0 wt % or less when a gross weight of the tobacco raw material in the dry state is 100 wt %. The first condition is determined based on variations in the pH of the collection solution. The second condition is determined based on the remaining amount of nicotine component.

7 Claims, 8 Drawing Sheets

(51) Int. Cl.

| | |
|---|---|
| ***A24B 15/28*** | (2006.01) |
| ***A24B 15/167*** | (2020.01) |

(56) References Cited

U.S. PATENT DOCUMENTS

| | | | | |
|---|---|---|---|---|
| 2,822,306 | A | 2/1958 | Thienemann et al. | |
| 4,244,381 | A | 1/1981 | Lendvay | |
| 4,941,484 | A | 7/1990 | Clapp et al. | |
| 5,005,593 | A | 4/1991 | Fagg | |
| 5,018,540 | A * | 5/1991 | Grubbs | A24B 15/24 131/297 |
| 5,038,802 | A | 8/1991 | White et al. | |
| 5,065,775 | A | 11/1991 | Fagg | |
| 5,121,757 | A | 6/1992 | White et al. | |
| 5,235,992 | A | 8/1993 | Sensabaugh, Jr. | |
| 5,311,886 | A | 5/1994 | De Grandpre et al. | |
| 5,435,325 | A | 7/1995 | Clapp et al. | |
| 5,445,169 | A | 8/1995 | Brinkley et al. | |
| 5,533,530 | A | 7/1996 | Young et al. | |
| 5,715,844 | A | 2/1998 | Young et al. | |
| 6,058,940 | A | 5/2000 | Lane | |
| 6,109,272 | A | 8/2000 | Saito et al. | |
| 2007/0023058 | A1 * | 2/2007 | Howell | A24B 15/243 131/298 |
| 2007/0137665 | A1 | 6/2007 | Torikai et al. | |
| 2007/0193596 | A1 | 8/2007 | Mori et al. | |
| 2011/0155152 | A1 | 6/2011 | Harris et al. | |
| 2012/0006345 | A1 | 1/2012 | Yajima et al. | |

FOREIGN PATENT DOCUMENTS

| | | | |
|---|---|---|---|
| EP | 1 782 702 | A1 | 5/2007 |
| EP | 1 915 064 | A2 | 4/2008 |
| JP | 54-52798 | A | 4/1979 |
| JP | 1-235571 | A | 9/1989 |
| JP | 2-49572 | A | 2/1990 |
| JP | 2-238873 | A | 9/1990 |
| JP | 3-10667 | A | 1/1991 |
| JP | 5-7485 | A | 1/1993 |
| JP | 8-98672 | A | 4/1996 |
| JP | 8-504598 | A | 5/1996 |
| JP | 9-9947 | A | 1/1997 |
| JP | 2872408 | B2 | 1/1999 |
| JP | 11-113552 | A | 4/1999 |
| JP | 2002-520005 | A | 7/2002 |
| JP | 2003-516723 | A | 5/2003 |
| JP | 2006-180715 | A | 7/2006 |
| JP | 2009-502160 | A | 1/2009 |
| JP | 2009-261314 | A | 11/2009 |
| JP | 2011-522558 | A | 8/2011 |
| JP | 2013-507104 | A | 3/2013 |
| WO | WO 94/24592 | A1 | 11/1994 |
| WO | WO 2005/122803 | A1 | 12/2005 |
| WO | WO 2006/022198 | A1 | 3/2006 |
| WO | WO 2006/046517 | A1 | 5/2006 |
| WO | WO 2007/052159 | A2 | 5/2007 |
| WO | WO 2007/052159 | A3 | 5/2007 |
| WO | WO 2007/053097 | A1 | 5/2007 |
| WO | WO 2010-110277 | A1 | 9/2010 |
| WO | WO 2011/042166 | A1 | 4/2011 |
| WO | WO 2013/146952 | A1 | 10/2013 |

OTHER PUBLICATIONS

Database WPI, Week 201427, Thomson Scientific, London, GB; AN 2014-G75248 XP002781324 & CN 103 589 514 A (Shanghai Tocacco Group Co., Ltd.), Feb. 19, 2014, abstract.
Extended European Search Report dated Jun. 5, 2018, in European Patent Application No. 15852051.0.
International Search Report for PCT/JP2015/055208 (PCT/ISA/210) dated May 19, 2015.
Written Opinion of the International Searching Authority for PCT/JP2015/055208 (PCT/ISA/237) dated May 19, 2015.
First Office Action dated Jun. 9, 2017, in Chinese Patent Application No. 201480076381.X, with English translation.
Extended European Search Report dated Aug. 25, 2017, in European Patent Application No. 15755597.0.
Extended European Search Report dated Oct. 4, 2017, in European Patent Application No. 15755206.8.
Extended European Search Report dated Sep. 14, 2017, in European Patent Application No. 14883799.0.
Notification of Reasons for Refusal dated Sep. 12, 2017, in Japanese Patent Application No. 2016-555187, with English translation.
Official Action dated Sep. 29, 2017, in Russian Patent Application No. 206137908, with English translation.
Second Office Action dated Jan. 12, 2018, in Chinese Patent Application No. 201480076381.X, with English translation.
Notification of Examination Result dated Jan. 9, 2017, in Taiwan Patent Application No. 104134843, with English translation.
Notification of Reason(s) for Refusal dated Feb. 7, 2017, in Japanese Patent Application No. 2016-504994, with English translation.
Canadian Office Action for corresponding Canadian Application No. 2,940,612, dated Oct. 13, 2017.
Canadian Office Action for corresponding Canadian Application No. 2,940,680, dated Oct. 12, 2017.
Canadian Office Action for corresponding Canadian Application No. 2,940,690, dated Oct. 13, 2017.
Chinese Office Action for corresponding Chinese Application No. 201580010569.9, dated Jun. 2, 2017, with English translation.
Chinese Office Action for corresponding Chinese Application No. 201580010590.9, dated Jun. 2, 2017, with English translation.
International Search Report for International Application No. PCT/JP2014/078410, dated Feb. 3, 2015.
International Search Report for International Application No. PCT/JP2015/055209, dated May 19, 2015.
International Search Report for International Application No. PCT/JP2015/079053, dated Dec. 28, 2015.
Korean Office Action for corresponding Korean Application No. 10-2016-7022737, dated Oct. 30, 2017, with English translation.
Korean Office Action for corresponding Korean Application No. 10-2016-7022739, dated Oct. 30, 2017, with English translation.
U.S. Office Action for U.S. Appl. No. 15/246,753, dated Jun. 28, 2018.
U.S. Office Action for U.S. Appl. No. 15/493,400, dated Feb. 25, 2019.
U.S. Office Action for U.S. Appl. No. 15/493,400, dated Jul. 12, 2018.
U.S. Office Action for U.S. Appl. No. 15/493,400, dated May 22, 2019.
U.S. Office Action for copending U.S. Appl. No. 15/246,753, dated Feb. 7, 2019.
U.S. Office Action for U.S. Appl. No. 15/246,753, dated Oct. 21, 2019.
U.S. Appl. No. 15/493,400, filed Apr. 21, 2017.
U.S. Office Action issued in U.S. Appl. No. 15/247,166 dated Oct. 29, 2018.

* cited by examiner

FIG. 5

| SAMPLE | TYPE | Nic. AMOUNT [wt%-DB] | $NH_4^+$ AMOUNT [ug/g-DB] |
|---|---|---|---|
| SAMPLE A | BURLEY TYPE | 4.9 | 4545 |
| SAMPLE B | FLUE CURED TYPE | 4.2 | 568 |
| SAMPLE C | FLUE CURED TYPE | 1.8 | 543 |
| SAMPLE D | BURLEY TYPE | 2.2 | 4211 |

EXTRACTION METHOD OF FLAVOR CONSTITUENT AND MANUFACTURING METHOD OF COMPOSITION ELEMENT OF FAVORITE ITEM

CROSS REFERENCE TO RELATED APPLICATIONS

This application is a Continuation of PCT International Application No. PCT/JP2015/055208, filed on Feb. 24, 2015, which claims priority under 35 U.S.C. 119(a) to Patent Application No. 2014-035429, filed in Japan on Feb. 26, 2014, all of which are hereby expressly incorporated by reference into the present application.

TECHNICAL FIELD

The present invention relates to an extraction method of flavor constituent and a producing method of a composition of a favorite item.

BACKGROUND ART

A technique has been conventionally proposed, in which a flavor constituent (e.g. alkaloid including a nicotine component) contributing to a tobacco flavor is extracted from a tobacco raw material and the extracted flavor constituent is supported on a base material for a flavor source.

As a technique related to a method for extracting a flavor constituent (hereinafter, a first prior art), for example, a method for removing a flavor constituent from a tobacco raw material by using ammonia gas is known (e.g. Patent Literature 1).

Alternatively, as a technique related to a method for extracting a flavor constituent (hereinafter, a second prior art), a supercritical extraction method by using an extraction solvent and a capture solvent is known (e.g. Patent Literature 2).

In the first prior art described above, it is required to apply pressure to ammonia gas. It is also required to separate a flavor constituent from ammonia gas, and a device for such separation is a large-scale device with a complicated mechanism. Therefore, capital investment costs are high and maintenance costs are also high.

In the second prior art described above, meanwhile, it is required to apply pressure to an extraction solvent, and a pressure container and a circulation pipe and the like are required, and a device for extracting a flavor constituent is a large-scale device as is the case with the first prior art. Therefore, capital investment costs are high and maintenance costs are also high.

CITATION LIST

Patent Literature

Patent Literature 1: JP S54-52798 A
Patent Literature 2: JP 2009-502160 A

SUMMARY

A first feature is summarized as an extraction method for extracting a flavor constituent from a tobacco raw material, comprising: a step A for heating a tobacco raw material which is subjected to an alkali treatment; and a step B for bringing a release component released in the gas phase in the step A into contact with a collection solvent at normal temperature until any time from when a first condition is satisfied to when a second condition is satisfied, wherein the total amount of saccharides contained in the tobacco raw material is 9.0 wt % or less in the case where a gross weight of the tobacco raw material in the dry state is 100 wt %, in a case where a stable zone in which variations in the pH of the collection solution are within a predetermined range exists in a time axis elapsing from beginning of the step A after pH of a collection solution containing the collection solvent and the release component decreases by 0.2 or more from the maximum value, the first condition is a condition that a time elapsing from the beginning of the step A reaches a start time of the stable zone, and the second condition is a condition that the remaining amount of nicotine component which is an index of the flavor constituent contained in the tobacco raw material decreases until reaching 0.3 wt % in the case where a weight of the tobacco raw material in the dry state is 100 wt %.

A second feature is summarized as the extraction method according to the first feature, wherein the second condition is a condition that the remaining amount of the nicotine component contained in the tobacco raw material decreases until reaching 0.4 wt % in the case where the weight of the tobacco raw material in the dry state is 100 wt %.

A third feature is summarized as the extraction method according to the first feature, wherein the second condition is a condition that the remaining amount of the nicotine component contained in the tobacco raw material decreases until reaching 0.6 wt % in the case where the weight of the tobacco raw material in the dry state is 100 wt %.

A fourth feature is summarized as the extraction method according to the first feature, wherein the second condition is a condition that the remaining amount of the nicotine component contained in the tobacco raw material decreases until reaching 0.7 wt % in the case where the weight of the tobacco raw material in the dry state is 100 wt %.

A fifth feature is summarized as the extraction method according to any one of the first feature to the fourth feature, wherein the tobacco raw material is subjected to a water addition treatment in the step A.

A six feature is summarized as the extraction method according to the first feature to the fifth feature, wherein the tobacco raw material is a burley type tobacco raw material.

A seventh feature is summarized as a manufacturing method of a composition of a favorite item, comprising: a step A for heating a tobacco raw material which is subjected to an alkali treatment; a step B for bringing a release component released in the gas phase in the step A into contact with a collection solvent at normal temperature until any time from when a first condition is satisfied to when a second condition is satisfied and for obtaining a collection solution; and a step C for adding the collection solution to the composition, wherein the total amount of saccharides contained in the tobacco raw material is 9.0 wt % or less in the case where a gross weight of the tobacco raw material in the dry state is 100 wt %, in a case where a stable zone in which variations in the pH of the collection solution are within a predetermined range exists in a time axis elapsing from beginning of the step A after pH of a collection solution containing the collection solvent and the release component decreases by 0.2 or more from the maximum value, the first condition is a condition that a time elapsing from the beginning of the step A reaches a start time of the stable zone, and the second condition is a condition that the remaining amount of the nicotine component contained in the tobacco raw material decreases until reaching 0.3 wt % when a weight of the tobacco raw material in the dry state is 100 wt %.

BRIEF DESCRIPTION OF DRAWINGS

FIG. 5 is a diagram illustrating the first experiment.

DESCRIPTION OF EMBODIMENTS

Figure 1:
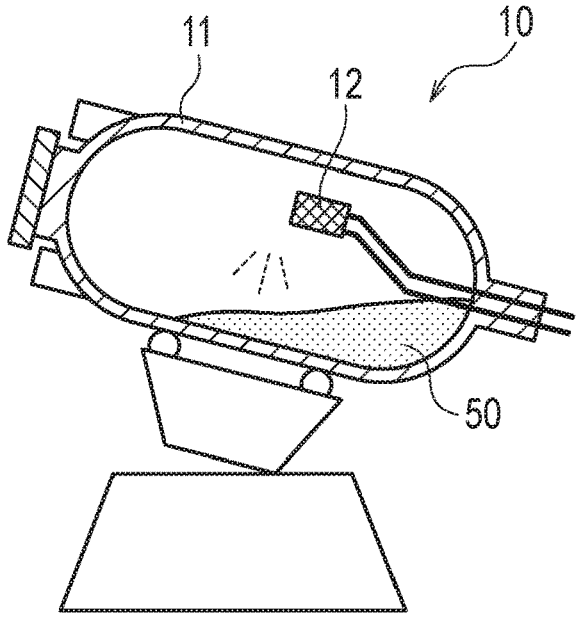
FIG. 1 is a diagram illustrating an example of the extraction device in the first embodiment.

Next, an embodiment will be described. Note that, the same or similar portions are denoted with the same or similar reference signs in the descriptions of the drawings below. Note that, the drawings are schematic and a ratio of each size is different from a real one.

Therefore, specific sizes and the like should be judged in consideration of the following descriptions. Needless to say, portions of which relationship and ratios of mutual sizes are different between the mutual drawings, are included.

Summary of Embodiments

The extraction method of flavor constituent according to the embodiments is a method for extracting a flavor constituent from a tobacco raw material. The extraction method comprises a step A for heating a tobacco raw material which is subjected to an alkali treatment; and a step B for bringing a release component released in the gas phase in the step A into contact with a collection solvent at normal temperature until any time from when a first condition is satisfied to when a second condition is satisfied. The total amount of saccharides contained in the tobacco raw material is 9.0 wt % or less in the case where the gross weight of the tobacco raw material in the dry state is 100 wt %. In a case where a stable zone in which variations in the pH of the collection solution are within a predetermined range exists in a time axis elapsing from beginning of the step A after pH of a collection solution containing the collection solvent and the release component decreases by 0.2 or more from the maximum value, the first condition is a condition that a time elapsing from the beginning of the step A reaches a start time of the stable zone. The second condition is a condition that the remaining amount of nicotine component which is an index of the flavor constituent contained in the tobacco raw material decreases until reaching 0.3 wt % in the case where a weight of the tobacco raw material in the dry state is 100 wt %.

In the embodiments, the step B for bringing a release component into contact with a collection solvent is continued at least until the first condition is satisfied. Thus, ammonium ion ($NH_4^+$) contained in the release component is sufficiently removed from the collection solution. Volatile impurity components (such as acetaldehyde and pyridine) other than ammonium ion are also removed from the collection solution. In the meantime, the step B for bringing a release component into contact with a collection solvent is finished at least by the time when the second condition is satisfied. Therefore, the step B is finished before the amount of Tobacco Specific Nitrosamines (TSNA) released increases, thereby inhibiting an increase in the amount of TSNA contained in the collection solution.

As described above, by simple treatments such as the step A and step B, as contamination by impurity components such as ammonium ion ($NH_4^+$) and TSNA is inhibited, a flavor constituent can be sufficiently extracted. That is, a flavor constituent can be extracted by a simple device.

It should be noted that a nicotine component is an example of a flavor constituent contributing to a tobacco flavor and is used as an index of a flavor constituent in the embodiments.

First Embodiment (Extraction Device)

Figure 2:
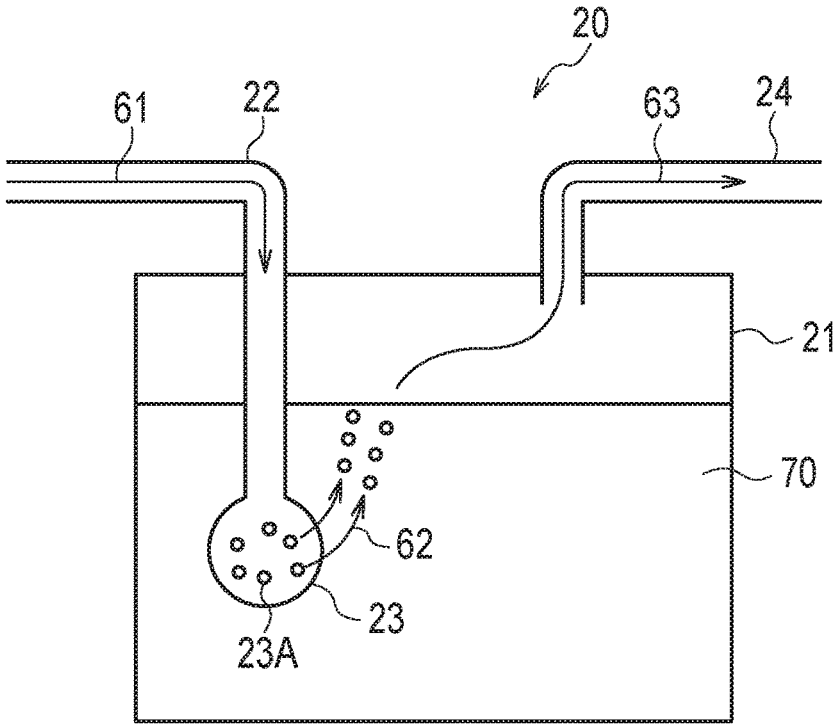
FIG. 2 is a diagram illustrating an example of the extraction device in the first embodiment.

The extraction device in the first embodiment will be described below. FIG. 1 and FIG. 2 are diagrams illustrating an example of the extraction device in the first embodiment.

First, an example of an alkali treatment device 10 will be described with reference to FIG. 1. The alkali treatment device 10 has a container 11 and a spray 12.

A tobacco raw material 50 is put in the container 11. The container 11 is constituted of for example members with heat resistance and pressure resistance (e.g. SUS; Steel Used Stainless). It is preferred that the container 11 constitute a sealed space. The "sealed space" is a state to prevent contamination by solid foreign substances in normal handling (e.g. transportation, storage). Therefore, the vaporization of a flavor constituent contained in the tobacco raw material 50 to the outside of the container 11 is inhibited.

The spray 12 provides an alkaline substance for the tobacco raw material 50. It is preferred that a basic substance such as an aqueous solution of potassium carbonate, for example, be used as an alkaline substance.

It is preferred that the spray 12 provide an alkaline substance for the tobacco raw material 50 until the pH of the tobacco raw material 50 becomes 8.0 or more. It is further preferred that the spray 12 provide an alkaline substance for the tobacco raw material 50 until the pH of the tobacco raw material 50 becomes in a range from 8.9 to 9.7. In order to efficiently release a flavor constituent in the gas phase from the tobacco raw material 50, the amount of water in the tobacco raw material 50 after spraying of an alkaline substance is preferably 10 wt % and further preferably 30 wt % or more. The upper limit of the amount of water in the tobacco raw material 50 is not particularly limited, and is for example preferably 50 wt % or less in order to efficiently heat the tobacco raw material 50.

The total amount of saccharides contained in the tobacco raw material 50 is 9.0 wt % or less in the case where the gross weight of the tobacco raw material 50 in the dry state is 100 wt %. The saccharides contained in the tobacco raw material 50 are sucrose (saccharose), fructose, glucose, maltose and inositol.

It is preferred that the initial amount of flavor constituent (herein, a nicotine component) contained in the tobacco raw material 50 be 2.0 wt % or more in the case where the gross weight of the tobacco raw material 50 in the dry state is 100 wt %. It is further preferred that the initial amount of flavor constituent (herein, a nicotine component) contained be 4.0 wt % or more.

As the tobacco raw material 50, for example, Nicotiana raw materials such as Nicotiana. tabacum and Nicotiana. rustica can be used. As Nicotiana tabacum, for example, a variety such as Burley type or flue cured type can be used. As the tobacco raw material 50, a tobacco raw material of a type other than Burley type and flue cured type may be also used. As described below, the tobacco raw material 50 in which the total amount of saccharides contained in the tobacco raw material 50 is 9.0 wt % or less is preferably used from the viewpoint of clearly confirming the stable zone of pH showing that the concentration of ammonium ion in a collection solution is sufficiently reduced. Further preferably, the total amount of saccharides contained in the tobacco raw material 50 is preferably 1.0 wt % or less. Further preferably, the total amount of saccharides contained in the tobacco raw material 50 is preferably 0.7 wt % or less.

The tobacco raw material 50 may be constituted of a cut or powder tobacco raw material. In such case, the diameter of a cut or powder substance is preferably 0.5 mm to 1.18 mm.

Second, an example of a collection device 20 will be described with reference to FIG. 2. The collection device 20 has a container 21, a pipe 22, a release section 23 and a pipe 24.

A collection solvent 70 is put in the container 21. The container 21 is constituted of for example a glass. It is preferred that the container 21 constitute a sealed space. The "sealed space" is a state to prevent contamination by solid foreign substances in normal handling (e.g. transportation, storage).

The temperature of the collection solvent 70 is for example normal temperature. The lower limit of normal temperature is for example a temperature at which the collection solvent 70 is not solidified, preferably 10° C. The upper limit of normal temperature is for example 40° C. or less. By setting the temperature of the collection solvent 70 to 10° C. or more and 40° C. or less, as the vaporization of a flavor constituent from a collection solution is inhibited, volatile impurity components such as ammonium ion and pyridine can be efficiently removed from the collection solution. As the collection solvent 70, for example, glycerin, water or ethanol can be used. In order to prevent the revaporization of a flavor constituent captured by the collection solvent 70, any acid such as malic acid or citric acid may be added to the collection solvent 70. In order to raise capture efficiency for a flavor constituent, a component or a substance such as an aqueous solution of citric acid may be added to the collection solvent 70. That is, the collection solvent 70 may be constituted of several types of component or substance. In order to raise capture efficiency for a flavor constituent, the initial pH of the collection solvent 70 is preferably lower than the pH of the tobacco raw material 50 after an alkali treatment.

The pipe 22 takes a release component 61, which is released in the gas phase from the tobacco raw material 50 by heating the tobacco raw material 50, to the collection solvent 70. The release component 61 contains at least a nicotine component which is an index of a flavor constituent. Since the tobacco raw material 50 is subjected to an alkali treatment, the release component 61 contains ammonium ion in some cases depending on time elapsing from the beginning of the collection step of a flavor constituent (treatment time). The release component 61 contains TSNA in some cases depending on time elapsing from the beginning of the collection step (treatment time).

A release section 23 is provided on the tip of the pipe 22 and immersed in the collection solvent 70. The release section 23 has a plurality of openings 23A. The release component 61 taken by the pipe 22 is released in the collection solvent 70 from a plurality of openings 23A as a foam-like release component 62.

The pipe 24 takes a residual component 63 which has not been captured by the collection solvent 70 to the outside of the container 21.

Since the release component 62 is a component which is released in the gas phase by heating the tobacco raw material 50, there is a possibility that the temperature of the collection solvent 70 is raised by the release component 62. Therefore, the collection device 20 may have a function for cooling the collection solvent 70 to maintain the temperature of the collection solvent 70 to normal temperature.

The collection device 20 may have a raschig ring to increase the contact area of the release component 62 with the collection solvent 70.

(Application Example)

Figure 3:
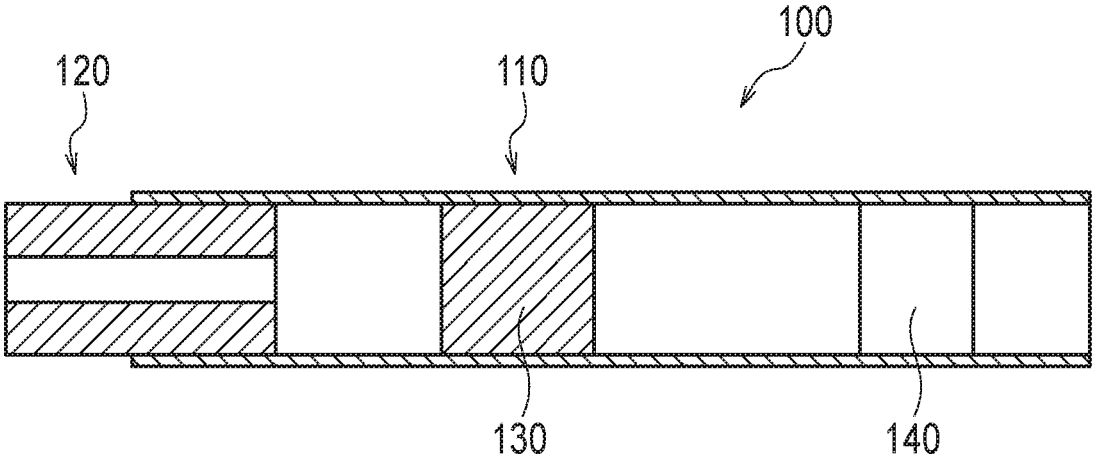
FIG. 3 is a diagram illustrating an example of the application of a flavor constituent.

An example of the application of a flavor constituent extracted from the tobacco raw material 50 will be described below. FIG. 3 is a diagram illustrating an example of the application of a flavor constituent. For example, a flavor constituent is provided for a constituent of a favorite item (e.g. a flavor source for a flavor inhaler).

As shown in FIG. 3, a flavor inhaler 100 has a holder 110, a carbon heat source 120, a flavor source 130 and a filter 140.

The holder 110 is for example a paper pipe with a tubular shape. The carbon heat source 120 generates heat to heat the flavor source 130. The flavor source 130 is a substance to generate a flavor and is an example of a base material for a flavor source for which alkaloid including a nicotine component is provided. The filter 140 inhibits the introduction of impurity substances to the mouthpiece side.

The flavor inhaler 100 is described herein as an example of the application of a flavor constituent, but the embodiments are not limited thereto. A flavor constituent may be applied to other inhalers, for example, an aerosol source for electronic cigarettes (what is called E-liquid). In addition, a flavor constituent may be provided for base materials for a flavor source such as gum, tablets, films and candy.

(Extraction Method)

Figure 4:
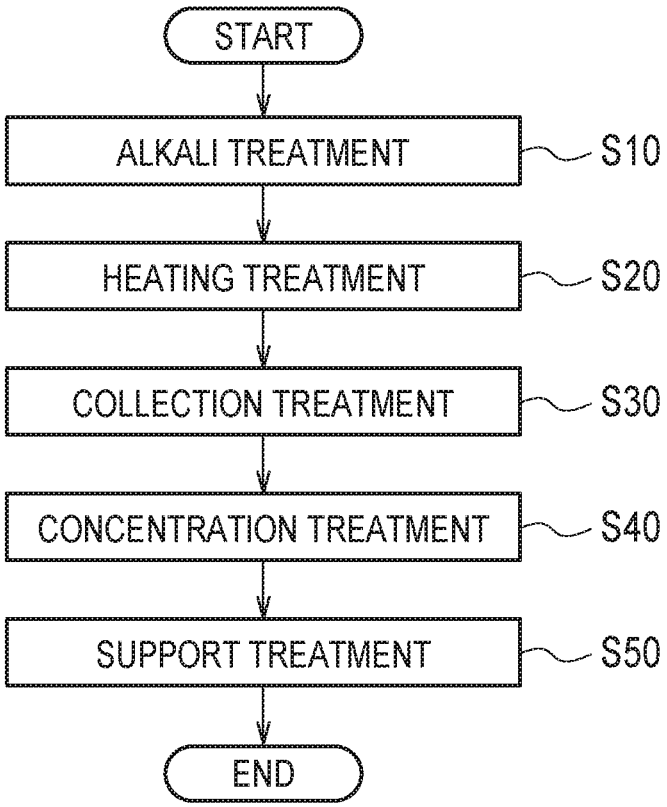
FIG. 4 is a flow diagram showing the extraction method in the first embodiment.

The extraction method involved in the first embodiment will be described below. FIG. 4 is a flow diagram showing the extraction method according to the first embodiment.

As shown in FIG. 4, an alkaline substance is provided for the tobacco raw material 50 using the alkali treatment device 10 described above in Step S10. As the alkaline substance, for example, a basic substance such as an aqueous solution of potassium carbonate can be used.

The total amount of saccharides contained in the tobacco raw material 50 is 9.0 wt % or less as described above in the case where the gross weight of the tobacco raw material 50 in the dry state is 100 wt %. The saccharides contained in the tobacco raw material 50 are fructose, glucose, saccharose, maltose and inositol.

It is preferred that the initial amount of flavor constituent (herein, a nicotine component) contained in the tobacco raw material 50 be 2.0 wt % or more in the case where the gross weight of the tobacco raw material 50 in the dry state is 100 wt %. It is further preferred that the initial amount of flavor constituent (herein, a nicotine component) contained be 4.0 wt % or more.

The pH of the tobacco raw material 50 after an alkali treatment is preferably 8.0 or more as described above. Further preferably, the pH of the tobacco raw material 50 after an alkali treatment is preferably in a range from 8.9 to 9.7.

The tobacco raw material 50 may be subjected to a water addition treatment in Step S10. The amount of water in the tobacco raw material 50 before the water addition treatment is preferably 10 wt % or more, further preferably 30 wt % or more. The upper limit of the amount of water in the tobacco raw material 50 is not particularly limited, and for example preferably 50 wt % or less to efficiently heat the tobacco raw material 50.

The tobacco raw material 50 which has been subjected to an alkali treatment is heated in Step S20. In the heating treatment, for example, the tobacco raw material 50 can be heated with the container 11 with the tobacco raw material 50 put in the container 11 in the alkali treatment device 10. In such case, it is needless to say that the pipe 22 in the collection device 20 is attached to the container 11.

The heating temperature of the tobacco raw material 50 is in a range from 80° C. or more to less than 150° C. By setting the heating temperature of the tobacco raw material 50 to 80° C. or more, a time when a flavor constituent is sufficiently released from the tobacco raw material 50 can be earlier. By setting the heating temperature of the tobacco raw material 50 to less than 150° C., meanwhile, a time when TSNA is released from the tobacco raw material 50 can be delayed.

The tobacco raw material 50 can be subjected to a water addition treatment in Step S20. The amount of water in the tobacco raw material 50 after the water addition treatment is preferably 10% or more and 50% or less. In addition, water may be continuously added to the tobacco raw material 50 in Step S20. It is preferred that the amount of water added be adjusted so that the amount of water in the tobacco raw material 50 will be 10% or more and 50% or less.

It is also preferred that the tobacco raw material 50 be subjected to an aeration treatment in Step S20. Therefore, the amount of flavor constituent contained in the release component 61 which is released in the gas phase from the alkali-treated tobacco raw material 50 can be increased. In the aeration treatment, for example, saturated water vapor at 80° C. is brought into contact with the tobacco raw material 50. The aeration time in the aeration treatment varies depending on a device for treating the tobacco raw material 50 and the amount of tobacco raw material 50, and thus cannot be necessarily specified, and for example, the aeration time is within 300 minutes when the tobacco raw material 50 is 500 g. The gross aeration volume in the aeration treatment also varies depending on a device for treating the tobacco raw material 50 and the amount of tobacco raw material 50, and thus cannot be necessarily specified, and for example, the volume is about 10 L/g when the tobacco raw material 50 is 500 g.

Air used in the aeration treatment is not necessarily saturated water vapor. The amount of water in air used in the aeration treatment may be adjusted so that water contained in the tobacco raw material 50 to which the heating treatment and the aeration treatment have been applied is for example less than 50% without particularly requiring the humidification of the tobacco raw material 50. The gas used in the aeration treatment is not limited to air and may be inert gases such as nitrogen and argon.

In Step S30, a release component which is released in the gas phase in Step S20 is brought into contact with the collection solvent 70 at normal temperature until any time from when the first condition is satisfied to when the second condition is satisfied using the above-described collection device 20. It should be noted that Step S20 and Step S30 are shown as different treatments in FIG. 4 for the convenience of illustration, but Step S20 and Step S30 are treatments which are carried out in parallel. Being carried out in parallel means that the period to carry out Step S30 overlaps with the period to carry out Step S20, and it should be noted that Step S20 and Step S30 do not need to start and finish at the same time.

In Step S20 and Step S30, the pressure in the container 11 in the alkali treatment device 10 is not more than normal pressure. Specifically, the upper limit of the pressure in the container 11 in the alkali treatment device 10 is +0.1 MPa or less as gauge pressure. In addition, a reduced pressure atmosphere may be inside the container 11 in the alkali treatment device 10.

As the collection solvent 70, for example, glycerin, water or ethanol can be used as described above. The temperature of the collection solvent 70 is normal temperature as described above. The lower limit of normal temperature is for example a temperature at which the collection solvent 70 is not solidified, preferably 10° C. The upper limit of normal temperature is for example 40° C. or less.

The first condition is a condition that when, after the pH of a collection solution containing the collection solvent 70 and the release component 62 decreases by 0.2 or more from the maximum value, a stable zone in which variations in the pH of the collection solution are within a predetermined range exists in the time axis elapsing from the beginning of Step S20, the time elapsing from the beginning of Step S20 (hereinafter, treatment time) reaches the start time of the stable zone.

The stable zone is a zone in which variations in the pH of a collection solution are within a predetermined range (e.g. the average variation per unit of time is ±0.01/min), and in such zone, the range of variations in the pH of a collection solution is within a predetermined range (e.g. a difference between pH at a time when such zone starts and pH at a time when the second condition described below is satisfied is ±0.2). In a case where the stable zone in which variations in the pH of a collection solution are within a predetermined range exists after the pH of the collection solution decreases by 0.2 or more from the maximum value, the start time of the stable zone is for example a time when the pH of the collection solution stops decreasing.

The profile of the pH of a collection solution is measured in advance in the same conditions as in the actual treatments, and the pH of a collection solution is preferably replaced with treatment time. That is, the first condition is preferably replaced with treatment time. Therefore, it is not required to monitor variations in the pH of a collection solution in real time and ammonium ion ($NH_4^+$) can be removed from the collection solution by simple control.

In the case where the weight of the tobacco raw material 50 in the dry state is 100 wt %, the second condition is a condition that the remaining amount of flavor constituent (herein, a nicotine component) contained in the tobacco raw material 50 decreases until reaching 0.3 wt %. Further preferably, the second condition is a condition that the remaining amount of flavor constituent (herein, a nicotine component) contained in the tobacco raw material 50 decreases until reaching 0.4 wt % in the case where the weight of the tobacco raw material 50 in the dry state is 100 wt %. Further preferably, the second condition is a condition that the remaining amount of flavor constituent (herein, a nicotine component) contained in the tobacco raw material 50 decreases until reaching 0.6 wt % in the case where the weight of the tobacco raw material 50 in the dry state is 100 wt %. Further preferably, the second condition is a condition that the remaining amount of flavor constituent (herein, a nicotine component) contained in the tobacco raw material 50 decreases until reaching 0.7 wt % in the case where the weight of the tobacco raw material 50 in the dry state is 100 wt %.

The profile of the remaining amount of flavor constituent (herein, a nicotine component) contained in the tobacco raw material 50 is measured in advance in the same conditions as in the actual treatments, and the remaining amount of flavor constituent is preferably replaced with treatment time. That is, the second condition is preferably replaced with treatment time. Therefore, it is not required to monitor the remaining amount of flavor constituent in real time and an increase in the amount of TSNA contained in a collection solution can be inhibited by simple control.

In Step S40, in order to raise the concentration of a flavor constituent contained in a collection solution, the collection solvent 70 which has captured the flavor constituent (i.e. collection solution) is subjected to a vacuum concentration treatment, a heating concentration treatment or a salting-out treatment.

Since the vacuum concentration treatment is carried out in a sealed space, contact with air is limited, and it is not required that the collection solvent 70 be raised to a high temperature, and thus there is a little concern about changes in components. Therefore, types of collection solvent which can be used are increased by using vacuum concentration.

In the heating concentration treatment, there is concern about liquid denaturation, for example, oxidation of a flavor constituent, but there is a possibility that an effect for increasing a flavor is obtained. However, compared to the vacuum concentration, types of collection solvent which can be used are decreased. There is for example a possibility that a collection solvent having an ester structure such as MCT (Medium Chain Triglyceride) cannot be used.

In the salting-out treatment, compared to the vacuum concentration treatment, the concentration of a flavor constituent can be increased; however, the flavor constituent is separated into the liquid solvent phase and water phase, and thus the yield rate of the flavor constituent is low. In addition, it is supposed that the coexistence of a hydrophobic substance (such as MCT) is essential, and thus there is a possibility that salting-out does not occur depending on the ratio between collection solvent, water and flavor constituent.

In Step S50, a collection solution containing a flavor constituent is added to a constituent of a favorite item. That is, in Step S50, a flavor constituent captured by the collection solvent 70 is supported by a base material for a flavor source (a constituent of a favorite item).

It should be noted that since a main object of the first embodiment is to extract a flavor constituent, the treatments of Step S40 and Step S50 are not essential.

(Action and Effect)

In the first embodiment, Step S30 for bringing a release component into contact with the collection solvent 70 is continued at least until the first condition is satisfied. Therefore, ammonium ion ($NH_4^+$) contained in the release component is sufficiently removed from a collection solution. In addition, in the release from the tobacco raw material 50 and the extraction by a collection solvent, other volatile impurity components (specifically, acetaldehyde, pyridine) showing the same behavior as of ammonium ion are also removed from a collection solution by satisfying the first condition.

In the meantime, Step S30 for bringing a release component into contact with the collection solvent 70 is finished at least by the time when the second condition is satisfied. Therefore, by finishing S30 before the amount of TSNA released increases, an increase in the amount of TSNA contained in a collection solution is inhibited.

As described above, by the simple treatments such as Step S20 and Step S30, as contamination by impurity components such as ammonium ion ($NH_4^+$) and TSNA is inhibited, a flavor constituent can be sufficiently extracted. That is, a flavor constituent can be extracted by a simple device.

In the embodiment, non-volatile components contained in the tobacco raw material 50 do not move to a collection solvent, and only components volatilized at about 120° C. can be collected in the collection solvent, and thus it is effective that components collected by a collection solvent are used as an aerosol source for electronic cigarettes. Therefore, as an increase in volatile impurity components such as ammonium ion, acetaldehyde and pyridine is inhibited in electronic cigarettes, aerosol containing a tobacco flavor can be delivered to users, and further scorching of a heater to heat an aerosol source, and the like can be inhibited. The term "electronic cigarette" herein indicates a non-combustion type flavor inhaler or aerosol inhaler which comprises an electric heater to heat and atomize a liquid aerosol source and an aerosol source and is to deliver aerosol to users (e.g. an aerosol inhaler described in Japanese Patent No. 5196673, an aerosol electronic cigarette described in Japanese Patent No. 5385418, etc.).

Other Embodiments

The present invention is described by way of the embodiment described above. It should not be understood however that the present invention is limited to the description and figures forming parts of this disclosure. Various alternate embodiments, examples and operation techniques will be apparent to one skilled in the art by this disclosure.

For example, a collection solvent which contains a flavor constituent of the tobacco raw material 50 by contact with the flavor constituent released from the tobacco raw material 50 in Step S30 (i.e. collection solution) can be added to the tobacco raw material 50 from which the flavor constituent has been released in Step S20 (the residue of the tobacco raw material) (return treatment). By carrying out such return treatment, impurity components (such as ammonium ion and TSNA) can be further removed, and a tobacco raw material inhibiting the loss of a flavor constituent can be produced. In the return treatment, a collection solution to be added to the residue of a tobacco raw material may be neutralized. In the return treatment, after adding a collection solution to the residue of a tobacco raw material, the residue of the tobacco raw material containing a flavor constituent may be neutralized. It should be noted that after returning a collection solution to the residue of a tobacco raw material in the return treatment, the amount of flavor constituent (herein, a nicotine component) contained in the tobacco raw material is not more than the amount of flavor constituent (herein, a nicotine component) contained in the tobacco raw material before the flavor constituent is released.

Furthermore, before the above-described return treatment, the tobacco raw material 50 from which a flavor constituent has been released in Step S20 (the residue of the tobacco raw material) may be washed by a washing solvent. The washing solvent can include aqueous solvents, and specific examples thereof can be pure water and ultrapure water, and can include city water. Therefore, impurity substances remaining in the residue of the tobacco raw material are removed. Therefore, even in a case where the above-described return treatment is carried out, impurity components (such as ammonium ion and TSNA) can be further removed, and a tobacco raw material inhibiting the loss of a flavor constituent can be produced.

[Experimental Results]

(First Experiment)

In the first experiment, samples (Sample A to Sample D) shown in FIG. 5 were prepared and the pH of a collection solution and ammonium ion ($NH_4^+$) contained in a collection solution were measured under the following conditions.

Figure 6:
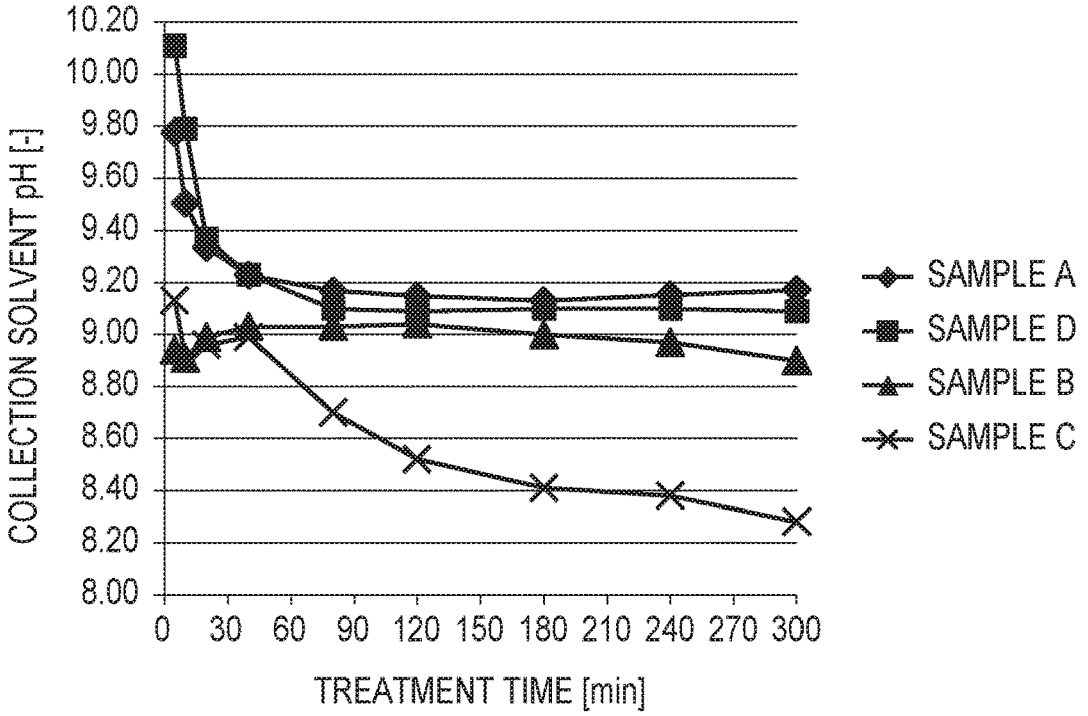
FIG. 6 is a diagram illustrating the first experiment.
Figure 7:
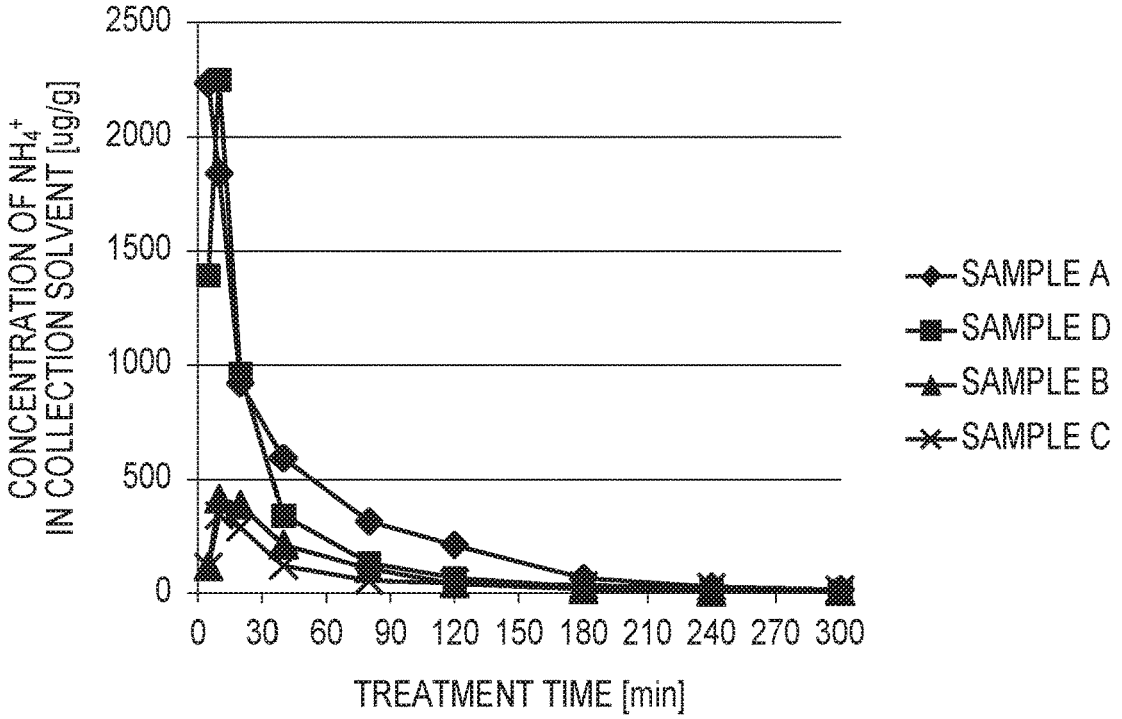
FIG. 7 is a diagram illustrating the first experiment.

The amount of nicotine (Nic. amount) and the amount of ammonium ion ($NH_4^+$ amount) contained in Sample A to Sample D in the dry state are as shown in FIG. 5. The amount of every saccharide (fructose, glucose, saccharose, maltose and inositol) contained in Sample A is almost zero (less than the detection limit), the total amount of saccharides (fructose, glucose, saccharose, maltose and inositol) contained in Sample B is 9.37 wt %, the total amount of saccharides (fructose, glucose, saccharose, maltose and inositol) contained in Sample C is 18.81 wt %, and the amount of saccharides (fructose, glucose, saccharose, maltose and inositol) contained in Sample D is 0.02 wt %. In addition, the measurement results of the pH of a collection solution are as shown in FIG. 6, and the measurement results of ammonium ion ($NH_4^+$) contained in a collection solution are as shown in FIG. 7. In FIG. 6 and FIG. 7, the treatment time is a time elapsing from the beginning of the heating treatment (S20) of a tobacco raw material. It can be thought that the treatment time is a time elapsing from the beginning of the collection treatment (S30) of a flavor constituent (hereinafter, a nicotine component).

Experimental Conditions

Amount of tobacco raw material: 500 g

Heating temperature of tobacco raw material: 120° C.

pH of tobacco raw material after alkali treatment: 9.6

Initial amount of water in tobacco raw material after alkali treatment: 39%±2%

Type of collection solvent: glycerin

Temperature of collection solvent: 20° C.

Amount of collection solvent: 61 g

Aeration flow during bubbling treatment (aeration treatment and collection treatment): 15 L/min The gas used in the bubbling treatment (aeration treatment) is the atmosphere at about 20° C. and about 60%-RH.

It was verified that in the profile of the pH of a collection solution, a stable zone in which variations in the pH of a collection solution are within a predetermined range existed after the pH of the collection solution decreased by 0.2 or more from the maximum value in Sample A and Sample D as shown in FIG. 6. It was verified that the concentration of ammonium ion ($NH_4^+$) contained in a collection solution was sufficiently reduced at a time when the stable zone starts (e.g. treatment time=40 minutes) as shown in FIG. 7.

On the other hand, it was verified that in the profile of the pH of a collection solution, a zone in which the pH of a collection solution decreases by 0.2 or more from the maximum value did not exist in Sample B as show in FIG. 6. It was verified that in the profile of the pH of a collection solution, the pH of a collection solution was intermittently reduced and the above-described stable zone did not exist in Sample C as shown in FIG. 6.

The stable zone is a zone in which variations in the pH of a collection solution is within a predetermined range (e.g. the average variation per unit of time is ±0.01/min) as described above, and in such zone, the range of variation in the pH of a collection solution is within a predetermined range (e.g. a difference between pH at a time when such zone starts and pH at a time when the second condition described below is satisfied is ±0.2).

It was verified that by the heating treatment and the collection treatment, saccharides (fructose, glucose, saccharose, maltose and inositol) contained in a tobacco raw material decreased and volatile organic acids (acetic acid, formic acid) increased. In addition, the increased amount of volatile organic acids was Sample C>Sample B>Sample D>Sample A, and it was verified that in a sample with a higher amount of saccharides contained in a tobacco raw material, the increased amount of volatile organic acids was higher. It is thought that this is because acid substances are produced by degradation of saccharides and move to a collection solution. In other words, it was verified that by using a burley type tobacco raw material with a low amount of saccharides contained in the tobacco raw material like Sample A and Sample D, specifically a tobacco raw material in which the total amount of saccharides contained in the tobacco raw material is 9.0 wt % or less, the stable zone of pH showing that the concentration of ammonium ion in a collection solution was sufficiently reduced could be clearly confirmed. In addition, by daring to use a burley type tobacco raw material with a high concentration of ammonium ion ($NH_4^+$), a profile with a pH decrease is easily confirmed. Furthermore, by the reducing treatment of ammonium ion ($NH_4^{30}$), volatile impurity components (specifically, acetaldehyde, pyridine) showing the same release and collection behavior as of ammonium ion ($NH_4^+$) are also reduced at the same time, and thus volatile impurity components (specifically, acetaldehyde, pyridine) are easily reduced.

Such experimental results verified that in a case where, after the pH of a collection solution decreased by 0.2 or more from the maximum value, a stable zone in which variations in the pH of a collection solution are within a predetermined range existed in the profile of the pH of a collection solution like Sample A and Sample D, when the treatment time went through the start time of the stable zone, the concentration of ammonium ion ($NH_4^+$) was sufficiently reduced. That is, it was verified that preferably the first condition was a condition that the treatment time reaches the start time of the stable zone.

(Second Experiment)

In the second experiment, samples of a burley type tobacco raw material (Sample A and Sample D described above) were prepared, and the remaining amount of alkaloid (herein, a nicotine component) contained in a tobacco raw material in the dry state (hereinafter, nicotine concentration in tobacco raw material), the recovery rate of alkaloid (herein, a nicotine component) contained in a collection solution (hereinafter, nicotine recovery rate) and the concentration of TSNA contained in a collection solution (hereinafter, TSNA concentration in collection solution) were measured under the following conditions.

Figure 8:
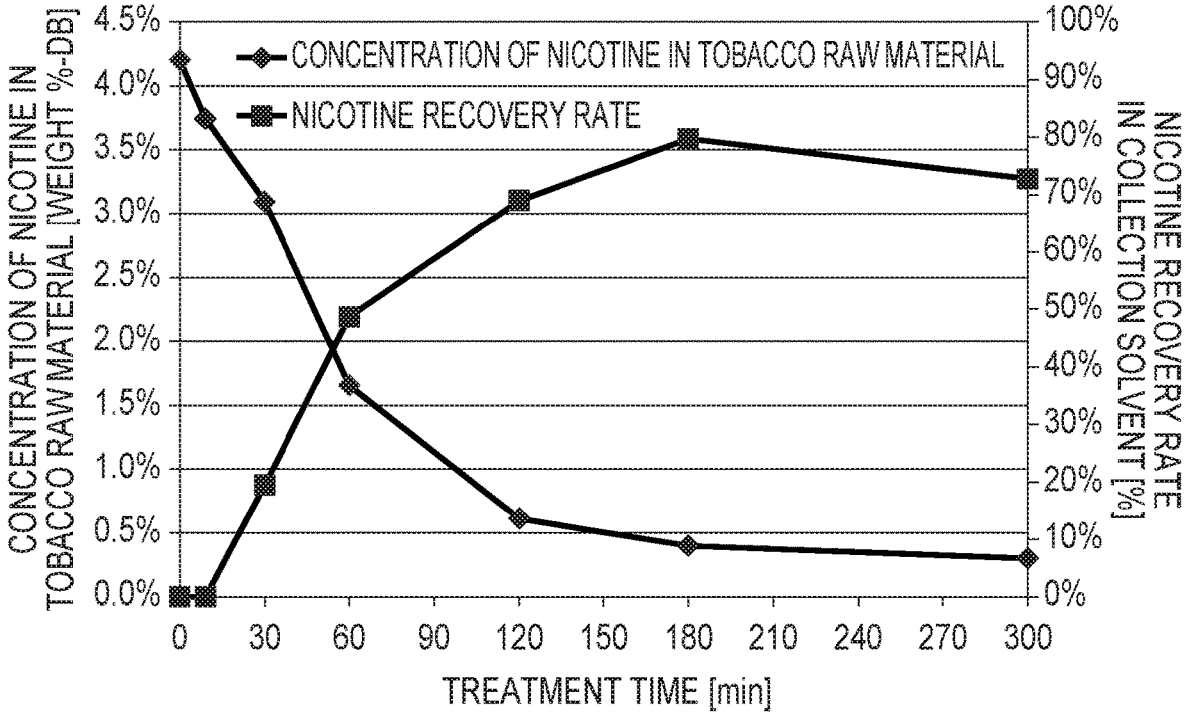
FIG. 8 is a diagram illustrating the second experiment.
Figure 9:
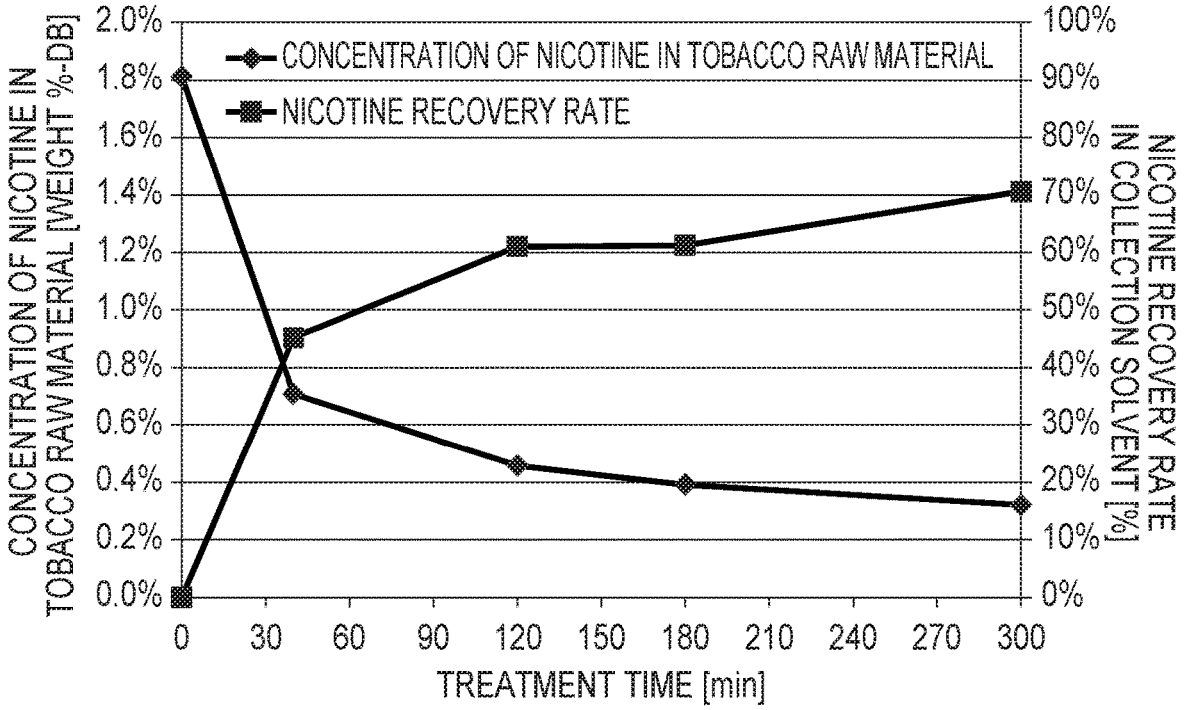
FIG. 9 is a diagram illustrating the second experiment.
Figure 10:
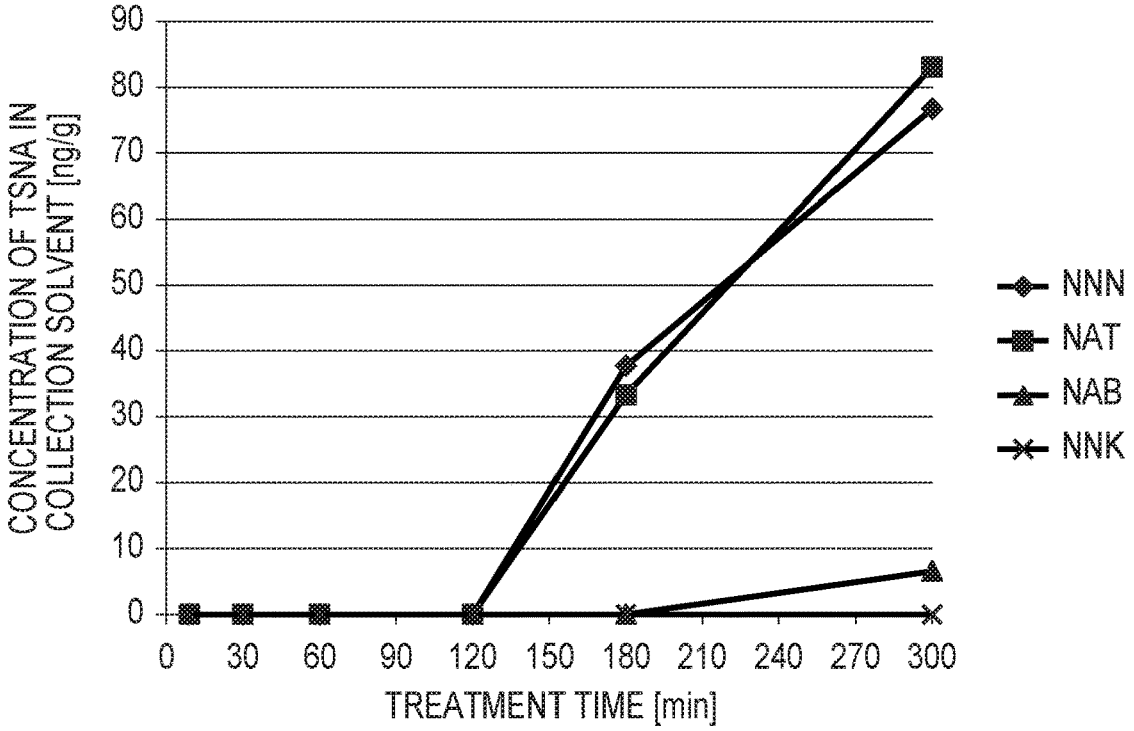
FIG. 10 is a diagram illustrating the second experiment.
Figure 11:
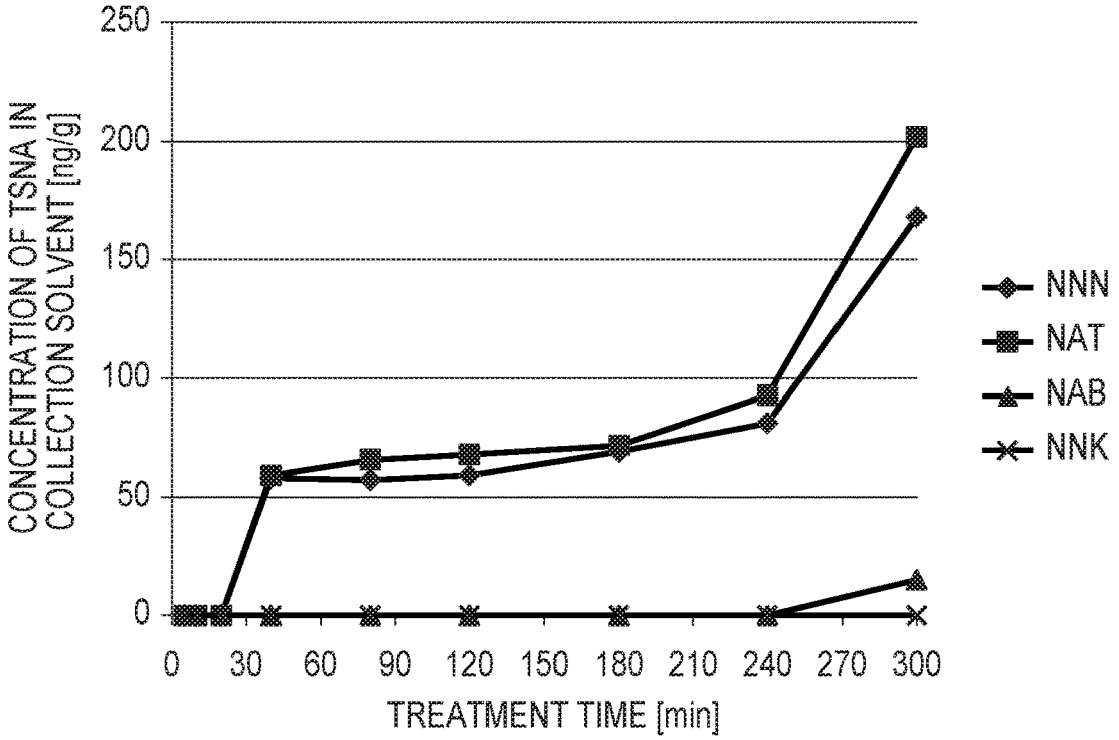
FIG. 11 is a diagram illustrating the second experiment.

The measurement results of the nicotine concentration in tobacco raw material and the nicotine recovery rate of Sample A are as shown in FIG. 8, and the measurement results of the nicotine concentration in tobacco raw material and the nicotine recovery rate of Sample D are as shown in FIG. 9. The measurement results of the concentration of TSNA contained in a collection solution of Sample A are as shown in FIG. 10, and the measurement results of the concentration of TSNA contained in a collection solution of Sample D are as shown in FIG. 11. The nicotine concentration in tobacco raw material is represented by percent by weight in the case where the weight of the tobacco raw material in the dry state is 100 wt %. The nicotine recovery rate is represented by the ratio to the initial weight of a nicotine component contained in a tobacco raw material in the dry state. The concentration of TSNA contained in a collection solution is represented by percent by weight in the case where the collection solution is 100 wt %. In FIG. 8 to FIG. 11, the treatment time is a time elapsing from the beginning of the heating treatment (S20) of a tobacco raw material. It can be thought that the treatment time is a time elapsing from the beginning of the collection treatment (S30) of a nicotine component.

About four types of TSNA, 4-(methylnitrosamino)-1-(3-pyridyl)-1-butanone (hereinafter, NNK), N'-nitrosonornicotine (hereinafter, NNN), N'-nitrosoanatabine (hereinafter, NAT) and N'-nitrosoanabasine (hereinafter, NAB), these concentrations were measured.

Experimental Conditions

Amount of tobacco raw material: 500 g
Heating temperature of tobacco raw material: 120° C.
pH of tobacco raw material after alkali treatment: 9.6
Initial amount of water in tobacco raw material after alkali treatment: 39% ±2%
Type of collection solvent: glycerin
Temperature of collection solvent: 20° C.
Amount of collection solvent: 60 g
Aeration flow during bubbling treatment (aeration treatment and collection treatment): 15 L/min The gas used in the bubbling treatment (aeration treatment) is the atmosphere at about 20° C. and about 60%-RH.

First, in Sample A, the remaining amount of nicotine component contained in a tobacco raw material intermittently decreases in the profile of the nicotine concentration in tobacco raw material as shown in FIG. 8. It was verified that NNK did not change but NNN, NAT and NAB increased after a lapse of a fixed period in the profile of TSNA concentration in collection solution as shown in FIG. 10.

Specifically, it was verified that when the treatment time reached a time when the nicotine concentration in tobacco raw material reaches 0.3 wt % (300 minutes in the present experimental result), the decrease rate of the remaining amount of nicotine component contained in a tobacco raw material (i.e. a rate at which the nicotine component is volatilized from the tobacco raw material) declined, and a rise in the recovery rate of nicotine component was not expected. It was also verified that when the treatment time went through a time when the nicotine concentration in tobacco raw material reaches 0.4 wt % (180 minutes in the present experimental result), NAB in a collection solution gradually increased. It was further verified that when the treatment time went through a time when the nicotine concentration in tobacco raw material reaches 0.6 wt % (120 minutes in the present experimental result), NNN and NAT in a collection solution considerably increased.

Second, in Sample D, the remaining amount of nicotine component contained in a tobacco raw material intermittently decreases in the profile of the nicotine concentration in tobacco raw material as shown in FIG. 9. It was verified that NNK did not change but NNN, NAT and NAB increased after a lapse of a fixed period in the profile of TSNA concentration in collection solution as shown in FIG. 11.

Specifically, it was verified that when the treatment time reached a time when the nicotine concentration in tobacco raw material reaches 0.3 wt % (300 minutes in the present experimental result), the decrease rate of the remaining amount of nicotine component contained in a tobacco raw material (i.e. a rate at which the nicotine component is volatilized from the tobacco raw material) declined, and a rise in the recovery rate of nicotine component was not expected. It was also verified that when the treatment time went through a time (240 minutes in the present experimental result) later than a time when the nicotine concentration in tobacco raw material reaches 0.4 wt % (180 minutes in the present experimental result), NAB in a collection solution gradually increased. It was further verified that when the treatment time went through a time when the nicotine concentration in tobacco raw material reaches 0.7 wt % (40 minutes in the present experimental result), NNN and NAT in a collection solution started to increase.

First, such experimental results verified that preferably the heating treatment (S20) and the collection treatment (S30) were finished before the time when the nicotine concentration in tobacco raw material reaches 0.3 wt % in both Sample A and Sample D. That is, it was verified that preferably the second condition was a condition that the nicotine concentration in tobacco raw material decreases until reaching 0.3 wt %.

Second, it was verified that further preferably the heating treatment (S20) and the collection treatment (S30) were finished before the time when the nicotine concentration in tobacco raw material reaches 0.4 wt % in both Sample A and Sample D. That is, it was verified that further preferably the second condition was a condition that the nicotine concentration in tobacco raw material decreases until reaching 0.4 wt %.

Third, it was verified that further preferably the heating treatment (S20) and the collection treatment (S30) were finished before the time when the nicotine concentration in tobacco raw material reaches 0.6 wt % in Sample A. That is, it was verified that further preferably the second condition was a condition that the nicotine concentration in tobacco raw material decreases until reaching 0.6 wt %.

Fourth, it was verified that further preferably the heating treatment (S20) and the collection treatment (S30) were finished before the time when the nicotine concentration in tobacco raw material reaches 0.7 wt % in Sample D. That is, it was verified that further preferably the second condition was a condition that the nicotine concentration in tobacco raw material decreases until reaching 0.7 wt %. It should be noted that by setting such second condition, NNN and NAT in a collection solution do not increase also in Sample A.

(Third Experiment)

Figure 12:
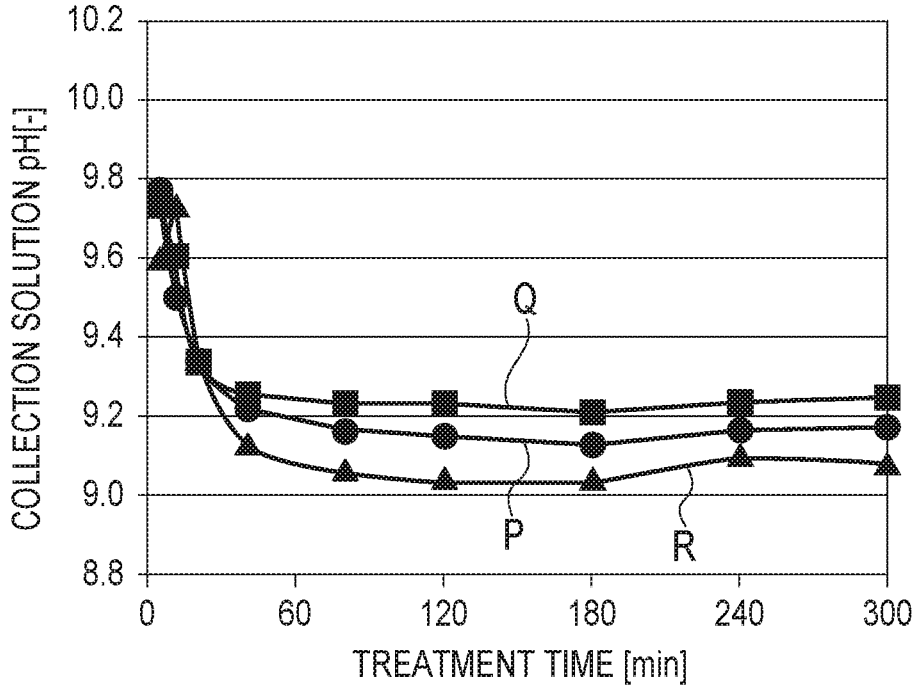
FIG. 12 is a diagram illustrating the third experiment.
Figure 13:
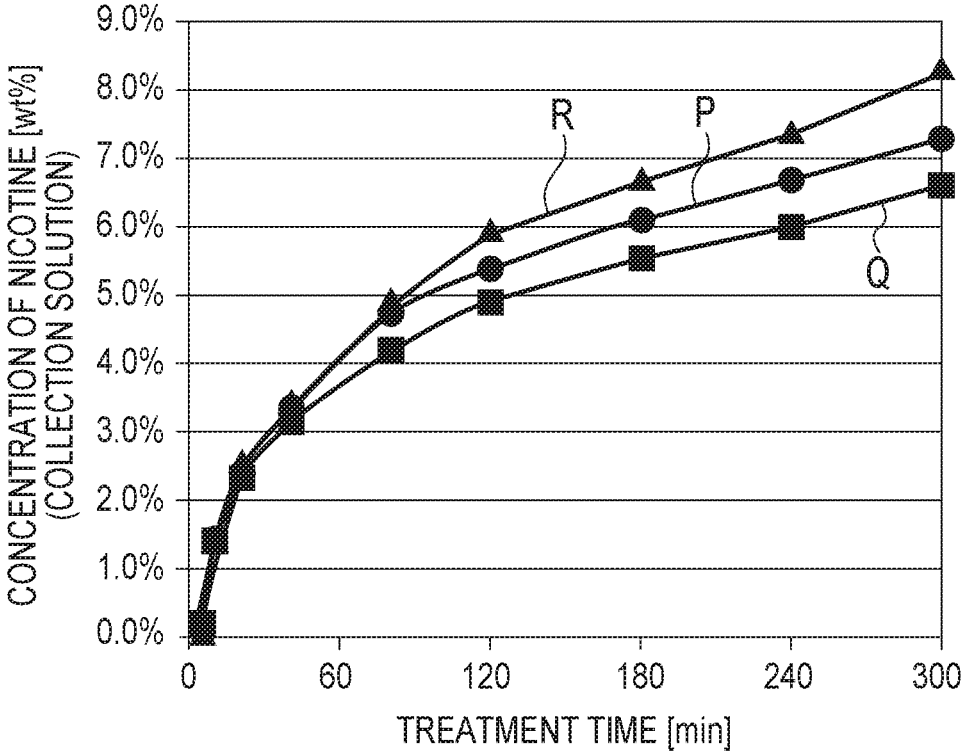
FIG. 13 is a diagram illustrating the third experiment.

In the third experiment, Sample P to Sample Q were prepared and the pH of a collection solution and the concentration of alkaloid (herein, a nicotine component) in a collection solution were measured under the following conditions. Sample P is a sample using glycerin as a collection solvent. Sample Q is a sample using water as a collection solvent. Sample R is a sample using ethanol as a collection solvent. The measurement results of the pH of a collection solution are as shown in FIG. 12. The measurement results of the concentration of nicotine component contained in a collection solution are as shown in FIG. 13. In FIG. 12 and FIG. 13, the treatment time is a time elapsing from the beginning of the heating treatment (S20) of a tobacco raw material. It can be thought that the treatment time is a time elapsing from the beginning of the collection treatment (S30) of a nicotine component.

Experimental Conditions

Amount of tobacco raw material: 500 g
Type of tobacco raw material; burley type
Heating temperature of tobacco raw material: 120° C.
pH of tobacco raw material after alkali treatment: 9.6
Temperature of collection solvent: 20° C.
Amount of collection solvent: 60 g Aeration flow during bubbling treatment (aeration treatment and collection treatment): 15 L/min The gas used in the bubbling treatment (aeration treatment) is the atmosphere at about 20° C. and about 60%-RH.

As shown in FIG. 12, when glycerin, water or ethanol was used as a collection solvent, the absolute values of pH of a collection solution in the stable zone were different, but a significant difference between collection solvents was not shown as the profile of the pH of a collection solution. Similarly, as shown in FIG. 13, when glycerin, water or ethanol was used as a collection solvent, a significant different between the concentrations of nicotine component contained in a collection solution was not shown.

Such experimental results verified that glycerin, water or ethanol could be used as a collection solvent.

(Fourth Experiment)

Figure 14:
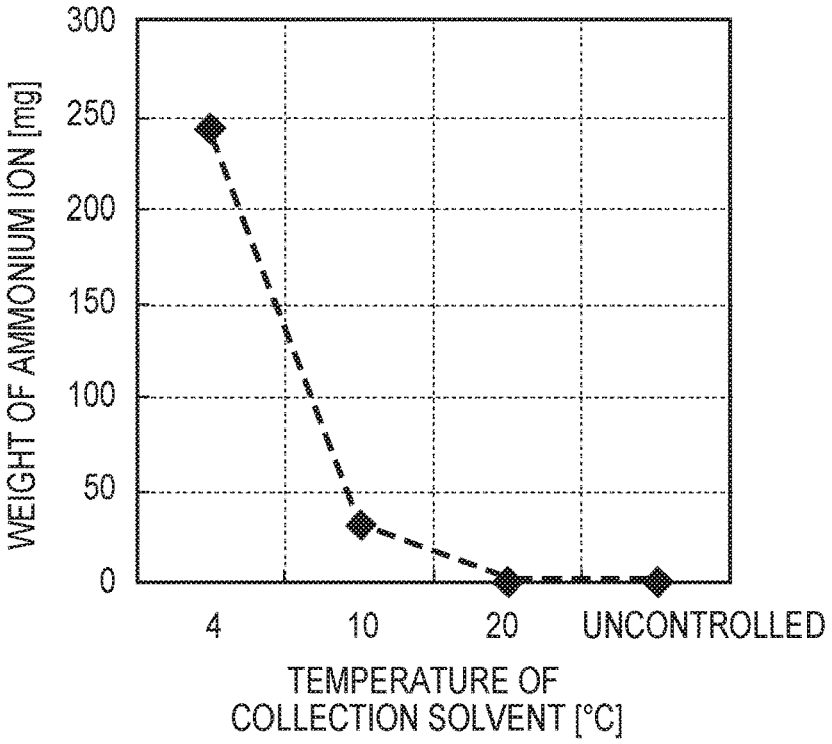
FIG. 14 is a diagram illustrating the fourth experiment.
Figure 15:
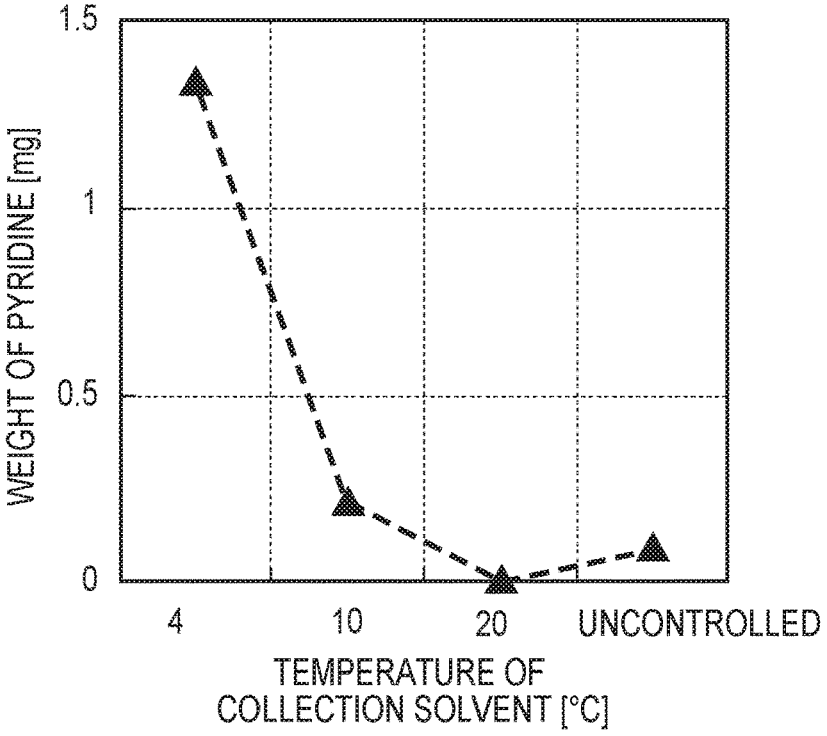
FIG. 15 is a diagram illustrating the fourth experiment.

In the fourth experiment, the weight of ammonium ion and pyridine contained in a collection solution was measured by changing the temperature of a collection solvent under the following conditions. The weight of ammonium ion contained in a collection solution is as shown in FIG. 14. The weight of pyridine contained in a collection solution is as shown in FIG. 15.

Experimental Conditions

Amount of tobacco raw material: 500 g

Type of tobacco raw material; burley type

Heating temperature of tobacco raw material: 120° C.

pH of tobacco raw material after alkali treatment: 9.6

Type of collection solvent: glycerin

Amount of collection solvent: 60 g

First, it was verified that when the temperature of a collection solvent was 10° C. or more, ammonium ion could be efficiently removed as shown in FIG. 14. In the meantime, it was verified that even when the temperature of a collection solvent was not controlled, ammonium ion could be efficiently removed. The vaporization of alkaloid (herein, a nicotine component) from a collection solution is inhibited as long as the temperature of a collection solvent is 40° C. or less. From such viewpoint, by setting the temperature of a collection solvent to 10° C. or more and 40° C. or less, as the vaporization of a nicotine component from a collection solution is inhibited, ammonium ion can be efficiently removed from the collection solution.

Second, it was verified that in the case where the temperature of a collection solvent was 10° C. or more, pyridine could be efficiently removed as shown in FIG. 15. In the meantime, it was verified that even when the temperature of a collection solvent was not controlled, pyridine could be efficiently removed. The vaporization of a nicotine component from a collection solution is inhibited as long as the temperature of a collection solvent is 40° C. or less. From such viewpoint, by setting the temperature of a collection solvent to 10° C. or more and 40° C. or less, as the vaporization of a nicotine component from a collection solution is inhibited, pyridine can be efficiently removed from the collection solution.

The temperature of a collection solvent is the preset temperature of the chiller (a constant-temperature bath) controlling the temperature of a container containing the collection solvent. It should be noted that in the present experimental conditions, the temperature of a collection solvent is settled about 60 minutes after the container is set in the chiller and the temperature control starts.

[Measurement Method]

(Method for Measuring pH of Collection Solution)

A collection solution was left to stand in a sealed container until room temperature in a laboratory controlled at room temperature of 22° C. to harmonize the temperature. After harmonization, the lid was opened, and the glass electrode of a pH meter (SevenEasy S20 manufactured by METTLER TOLEDO) was soaked in a collection solution to start the measurement. The pH meter was calibrated in advance using pH meter calibration liquids with pH 4.01, 6.87 and 9.21. A point at which output variations from a sensor become stable within 0.1 mV for 5 seconds was used as the pH of a collection solution.

(Method for Measuring $NH_4^+$ Contained in Collection Solution)

A collection solution was collected in an amount of 50 μL, and diluted by adding 950 μL of a 0.05 N aqueous solution of dilute sulfuric acid, and the diluted solution was analyzed by ion chromatography to quantitate ammonium ion contained in the collection solution.

(Method for Measuring Nicotine Component Contained in Tobacco Raw Material)

The measurement was carried out in a method in accordance with the German Institute for Standardization (DIN) 10373. That is, a tobacco raw material was collected in an amount of 250 mg, and 7.5 mL of a 11% aqueous solution of sodium hydroxide and 10 mL of hexane were added thereto, and shaking extraction was carried out for 60 minutes. After the extraction, the hexane phase, supernatant, was used for a gas chromatograph mass spectrometer (GC/MS) to quantitate the weight of nicotine contained in the tobacco raw material.

(Method for Measuring Amount of Water Contained in Tobacco Raw Material)

A tobacco raw material was collected in an amount of 250 mg, and 10 mL of ethanol was added thereto, and shaking extraction was carried out for 60 minutes. After the extraction, the extract liquid was filtered with a 0.45 μm membrane filter, and used for a gas chromatograph with thermal conductivity detector (GC/TCD) to quantitate the amount of water contained in the tobacco raw material.

The weight of the tobacco raw material in the dry state is calculated by subtracting the above-described amount of water from the gross weight of the tobacco raw material.

(Method for Measuring TSNA Contained in Collection Solution)

A collection solution was collected in an amount of 0.5 mL, and diluted by adding 9.5 mL of a 0.1 M aqueous solution of ammonium acetate, and the diluted solution was analyzed by a high performance liquid chromatograph-mass spectrometer (LC-MS/MS) to quantitate TSNA contained in the collection solution.

(GC Analysis Conditions)

The conditions of GC analysis used to measure the amounts of nicotine component and water contained in a tobacco raw material are as shown in Table given below.

TABLE 1

| | Nicotine | Moisture |
|---|---|---|
| Model number of device (Manufacturer) | Agilent 6890GC&5975MSD (Agilent technologies) | HP 6890 (Hewlett Packard) |
| GC column | DB-1ms | DB-WAX |

(Method for Measuring Pyridine Contained in Collection Solution)

A collection solution was collected in an amount of 1 mL, and diluted by adding 19 mL of methanol, and the diluted solution was used for a gas chromatograph mass spectrometer to quantitate the amount of pyridine contained in the collection solution.

The entire contents of Japanese patent application No. 2014-035429 (filed on Feb. 26, 2014) are incorporated herein by reference.

INDUSTRIAL APPLICABILITY

According to the embodiments, there can be provided an extraction method for extracting a flavor constituent (e.g. alkaloid including a nicotine component) using a simple device and a producing method of a composition of a favorite item.

The invention claimed is:

1. An extraction method for extracting a flavor constituent from a tobacco raw material, comprising:

a step A for heating a tobacco raw material, which was subjected to an alkali treatment, at a pressure of +0.1 MPa or less as gauge pressure so as to obtain a release component released from the tobacco raw material to a gas phase; and a step B for bringing the release component released in the gas phase in the step A into contact with a collection solvent at a temperature of 10 to 40° C. at a pressure of +0.1 MPa or less as gauge pressure until any time from when a first condition is satisfied to when a second condition is satisfied, so as to collect the release component by the collection solvent, wherein a total amount of saccharides contained in the tobacco raw material is 9.0 wt % or less based on a total weight of the tobacco raw material in the dry state, in a case where a stable zone, in which variations in the pH of a collection solution are within a predetermined range, exists in a time axis elapsing from beginning of the step A after pH of a collection solution, which contains the collection solvent and the release component, decreases by a pH value of 0.2 or more from a maximum value, the first condition is a condition that a time elapsing from the beginning of the step A reaches a start time of the stable zone, the maximum value being the highest value of the pH of the collection solution in the time axis elapsing from the beginning of the step A, and the second condition is a condition that the remaining amount of nicotine component, which is an index of the flavor constituent contained in the tobacco raw material, is decreased to 0.7 wt % or lower based on a total weight of the tobacco raw material in the dry state, as the remaining amount of nicotine component is being decreased in the step B.

2. The extraction method according to claim 1, wherein the second condition is a condition that the remaining amount of the nicotine component contained in the tobacco raw material is decreased to 0.6 wt % or lower based on the total weight of the tobacco raw material in the dry state.

3. The extraction method according to claim 1, wherein the second condition is a condition that the remaining amount of the nicotine component contained in the tobacco raw material is decreased to 0.4 wt % or lower based on the total weight of the tobacco raw material in the dry state.

4. The extraction method according to claim 1, wherein the second condition is a condition that the remaining amount of the nicotine component contained in the tobacco raw material is decreased to 0.3 wt % based on the total weight of the tobacco raw material in the dry state.

5. The extraction method according to claim 1, wherein the tobacco raw material is subjected to a water addition treatment in the step A.

6. The extraction method according to claim 1, wherein the tobacco raw material is a burley type tobacco raw material.

7. A manufacturing method of a composition of a favorite item, comprising:

a step A for heating a tobacco raw material, which was subjected to an alkali treatment, at a pressure of +0.1 MPa or less as gauge pressure so as to obtain a release component released from the tobacco raw material to a gas phase;

a step B for bringing the release component released in the gas phase in the step A into contact with a collection solvent at a temperature of 10 to 40° C. at a pressure of +0.1 MPa or less as gauge pressure until any time from when a first condition is satisfied to when a second condition is satisfied, so as to collect the release component by the collection solvent, thereby obtaining a collection solution; and a step C for adding the collection solution to the composition, wherein a total amount of saccharides contained in the tobacco raw material is 9.0 wt % or less based on a total weight of the tobacco raw material in the dry state, in a case where a stable zone, in which variations in the pH of the collection solution are within a predetermined range, exists in a time axis elapsing from beginning of the step A after pH of the collection solution, which contains the collection solvent and the release component, decreases by a pH value of 0.2 or more from a maximum value, the first condition is a condition that a time elapsing from the beginning of the step A reaches a start time of the stable zone, the maximum value being the highest value of the pH of the collection solution in the time axis elapsing from the beginning of the step A and the second condition is a condition that the remaining amount of the nicotine component contained in the tobacco raw material is decreased to 0.7 wt % or lower based on a total weight of the tobacco raw material in the dry state, as the remaining amount of nicotine component is being decreased in the step B.

* * * * *